US010183802B2

(12) United States Patent
Ogata et al.

(10) Patent No.: US 10,183,802 B2
(45) Date of Patent: Jan. 22, 2019

(54) SHOULDER COVER FOR AEROSOL CONTAINER

(71) Applicant: TOYO AEROSOL INDUSTRY CO., LTD., Tokyo (JP)

(72) Inventors: Ken Ogata, Tokyo (JP); Hirokazu Shimizu, Tokyo (JP); Toru Toma, Tokyo (JP); Yoshiyuki Kakuta, Tokyo (JP); Kotaro Fujiwara, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 458 days.

(21) Appl. No.: 14/952,678

(22) Filed: Nov. 25, 2015

(65) Prior Publication Data

US 2016/0075500 A1 Mar. 17, 2016

Related U.S. Application Data

(63) Continuation of application No. PCT/JP2014/063536, filed on May 22, 2014.

(30) Foreign Application Priority Data

May 31, 2013 (JP) ..... 2013-116438
May 31, 2013 (JP) ..... 2013-116440

(51) Int. Cl.
*B65D 83/14* (2006.01)
*B65D 83/26* (2006.01)
(Continued)

(52) U.S. Cl.
CPC ..... *B65D 83/28* (2013.01); *B65D 83/206* (2013.01); *B65D 83/345* (2013.01); *B65D 83/40* (2013.01); *B65D 83/68* (2013.01)

(58) Field of Classification Search
CPC ..... B65D 83/14; B65D 83/28; B65D 83/40; B65D 83/68
(Continued)

(56) References Cited

U.S. PATENT DOCUMENTS 3,647,107 A * 3/1972 La Grutta ..... B65D 83/40 220/783
3,773,227 A * 11/1973 Laing ..... B65D 50/045 215/301
(Continued)

FOREIGN PATENT DOCUMENTS

EP 2982615 A1 2/2016
JP 2012-30886 A 2/2012
(Continued)

OTHER PUBLICATIONS

International Search Report dated Jul. 15, 2014, issued in corresponding application No. PCT/JP2014/063536.

*Primary Examiner* — Andrew T Kirsch
(74) *Attorney, Agent, or Firm* — Westerman, Hattori, Daniels & Adrian, LLP

(57) ABSTRACT

A shoulder cover for an aerosol container that can be readily positioned and attached to the aerosol container having two stems. The shoulder cover is attached to a mounting cup that includes an upper tier part having two stems protruding from a top wall thereof and having long sides and short sides, and a cylindrical part. The shoulder cover includes an outer circumferential wall, a roof wall, a cylindrical wall extending downward from the roof wall, and locking structure provided to the cylindrical wall and retaining the shoulder cover by engaging with the cylindrical part of the mounting cup, and positioning structure for fitting with the upper tier part to thereby position a mating position of the shoulder cover is formed.

7 Claims, 9 Drawing Sheets

(51) Int. Cl.

| | |
|---|---|
| ***B65D 83/40*** | (2006.01) |
| ***B65D 83/68*** | (2006.01) |
| ***B65D 83/28*** | (2006.01) |
| ***B65D 83/20*** | (2006.01) |
| ***B65D 83/34*** | (2006.01) |

(58) Field of Classification Search
USPC ..... 220/780, 783, 784
See application file for complete search history.

(56) References Cited

U.S. PATENT DOCUMENTS

| | | | | |
|---|---|---|---|---|
| 6,186,371 | B1 | 2/2001 | de Pous et al. | |
| 8,925,765 | B2 | 1/2015 | Hanai et al. | |
| 9,027,799 | B2 | 5/2015 | Hanai et al. | |
| 2006/0049205 | A1* | 3/2006 | Green ..... | B65D 83/303 222/94 |
| 2009/0266850 | A1 | 10/2009 | Green | |
| 2013/0270294 | A1 | 10/2013 | Shibata et al. | |
| 2014/0008389 | A1 | 1/2014 | Mekata et al. | |
| 2015/0175341 | A1 | 6/2015 | Konno et al. | |

FOREIGN PATENT DOCUMENTS

| | | | |
|---|---|---|---|
| WO | 2012/011162 | A1 | 1/2012 |
| WO | 2012/073361 | A1 | 6/2012 |
| WO | 2012/086818 | A1 | 6/2012 |
| WO | 20131191248 | A1 | 12/2013 |

* cited by examiner

C-C CROSS SECTION

SHOULDER COVER FOR AEROSOL CONTAINER

TECHNICAL FIELD

The present invention relates to a shoulder cover for aerosol container, mounted to an aerosol container to encase a mounting cup of the container inside, and more particularly to a shoulder cover for an aerosol container containing two types of contents separately in one container and having a total of two stems for dispensing the contents.

BACKGROUND ART

As one type of aerosol containers containing two liquid types of hair dying, hair styling products or the like, a dual compartment aerosol container has hitherto been known, in which one container containing one type of content and another container containing another type of content form a pair of cylindrical containers arranged side by side. In such a dual compartment aerosol container, commonly, a nozzle that leads to the stems of the respective containers and dispenses, from one discharge tube, the contents discharged from the respective stems is provided, and in addition, a shoulder cover that covers the mounting cup of the container is provided, for example, for the purposes of holding both containers integrally, or for enhancing the decorative effect. Such a dual compartment aerosol container as a whole has a cross section in the form of a track, and correspondingly, the shoulder cover also has an outer shape in the form of a track, and therefore attachment of the shoulder cover to the container is relatively easy work because it can be set in position only by checking its orientation in the front to back direction relative to the container.

In regard to such aerosol containers for two liquid types, the number of occasions is increasing recently where an aerosol container that contains two types of contents separately in one container and has two stems, as shown for example in Patent Document 1, is used. While this type of container has a circular cross-sectional shape as a whole, the two stems are disposed side by side in a non-circular (such as, for example, elliptical or track-shaped) part provided in the mounting cup where the cross-sectional shape has long sides and short sides. Accordingly, when attaching the shoulder cover, it needs to be set in a proper position relative to the container so as to avoid interference with the two stems. However, since the shoulder cover has a circular outer shape correspondingly to the container, they cannot be positioned relative to each other based on their outer shapes, and the non-circular part of the mounting cup and part of the shoulder cover corresponding to this non-circular part need to be aligned with each other, which posed a problem that positioning for the attachment was troublesome.

PRIOR ART DOCUMENTS

Patent Documents

Patent Document 1: Japanese Patent Application Laid-open No. 2012-30886

SUMMARY OF THE INVENTION

Problems to be Solved by the Invention

The present invention is directed to resolve this problem, an object thereof being to propose a novel shoulder cover for aerosol container, which can be more easily positioned to an aerosol container with two stems in one container that is cylindrical.

Means for Solving the Problems

The shoulder cover for aerosol container of the present invention that solves the problem noted above resides in a shoulder cover for aerosol container attached to an aerosol container having a mounting cup, such as to encase the mounting cup inside, the mounting cup including an upper tier part having two stems protruding from a top wall thereof and having a non-circular cross-sectional shape with long sides and short sides, and a cylindrical part including a middle tier cylindrical part having a diameter substantially the same as the length of the long sides and connected to the upper tier part, and a lower tier cylindrical part having a larger diameter than that of the middle tier cylindrical part and connected to the middle tier cylindrical part, the shoulder cover including:

an outer circumferential wall, a roof wall, a cylindrical wall extending downward from the roof wall, and locking means formed by a convex section that is formed on an inner circumferential surface of the cylindrical wall and that retains the shoulder cover by engaging with the cylindrical part of the mounting cup, wherein positioning means for fitting with the non-circular upper tier part of the mounting cup to thereby position a mating position of the shoulder cover is formed.

A configuration can be adopted wherein the locking means is formed of a pair of convex sections circumferentially spaced in a lower part of the inner circumferential surface of the cylindrical wall that fits with the middle tier cylindrical part, and the positioning means includes a convex-shaped region where the convex sections are provided to face each other on the cylindrical wall and where a distance between the convex sections is shorter than the length of the long sides, and a non-convex-shaped region where portions not formed with the convex sections are provided to face each other and where the cylindrical wall has an inner diameter that is equal to or longer than the length of the long sides.

Preferably, the cylindrical wall should have an anti-rotation rib that abuts on a long side edge of the upper tier part along the long sides, at a position higher than the convex sections.

As another form, a configuration may be adopted wherein the locking means is formed of a convex section provided in a lower part of the inner circumferential surface of the cylindrical wall that fits with the lower tier cylindrical part, and the positioning means includes an inner circumferential wall extending downward from and integrally connected to the roof wall, and an annular wall integrally connected to a lower end of the inner circumferential wall via a weakened portion and having an inner circumferential shape conforming to an outer circumferential surface of the upper tier part, the annular wall having a lower end that abuts on the top wall at a position where the convex section is located above the lower tier cylindrical part when the shoulder cover is placed on top of the mounting cup.

The weakened portion may be formed as a thin wall that is thinner than the inner circumferential wall and the annular wall. The weakened portion may also be formed as a plurality of connecting pieces circumferentially spaced along the circumferential direction of the annular wall and intermittently connecting the inner wall and the annular wall.

Effects of the Invention

The shoulder cover of the present invention, by having the configuration described above, can be attached easily to the container, since, when the shoulder cover is placed on the aerosol container, the positioning means positions the shoulder cover at a mating position relative to the mounting cup, and when the shoulder cover is pressed in this state, the locking means engages with the cylindrical part of the mounting cup and lock the shoulder cover.

If the configuration is adopted, wherein the locking means is formed of a pair of circumferentially spaced convex sections in a lower part of the inner circumferential surface of the cylindrical wall that fits with the middle tier cylindrical part, and the positioning means includes a convex-shaped region where the convex sections are provided to face each other on the cylindrical wall and where a distance between the convex sections is shorter than the length of the long sides, and a non-convex-shaped region where portions not formed with the convex sections are provided to face each other and where the cylindrical wall has an inner diameter that is equal to or longer than the length of the long sides, when the shoulder cover is placed on the aerosol container, if the convex-shaped region of the shoulder cover overlaps the long sides of the upper tier part of the mounting cup, the convex sections ride on the top wall of the upper tier part. On the other hand, when the shoulder cover is turned relative to the container so that the non-convex-shaped region overlaps the long sides, the shoulder cover moves down until its convex sections abut on the cylindrical part of the mounting cup. Thus the completion of the positioning of the shoulder cover can be recognized.

The cylindrical wall may be provided with an anti-rotation rib that abuts on a long side edge of the upper tier part along the long sides, at a position higher than the convex sections, whereby the shoulder cover can be stopped from rotating relative to the aerosol container more firmly.

Further, by adopting the configuration set forth in claim 4, the annular wall of the shoulder cover that abuts on the top wall of the upper tier part of the mounting cup when the shoulder cover is placed on the aerosol container moves down to the middle tier cylindrical part when the shoulder cover is turned and the upper tier part and the annular wall are aligned with each other. That is, even when the shoulder cover is placed on the aerosol container without any care taken for its orientation, as the shoulder cover is turned, the shoulder cover height goes down when the shoulder cover is aligned with the container, whereby the completion of the positioning of the shoulder cover can be recognized. Moreover, the annular wall is integrally connected to the shoulder cover via the weakened portion, so that the annular wall can be broken off at the weakened portion when the shoulder cover is pressed from above after having been positioned. This way, although an annular wall is provided for the positioning purpose, the shoulder cover height after it is attached is the same as that without it, so that the shoulder cover is not increased in size.

If the weakened portion is formed as a thin wall that is thinner than the inner circumferential wall and the annular wall, or formed as a plurality of connecting pieces circumferentially spaced along the annular wall and intermittently connecting the inner circumferential wall and the annular wall, the weakened portion is simply configured and does not cause an increase in the production cost.

EXPLANATION OF REFERENCE NUMERALS

Figure 1:
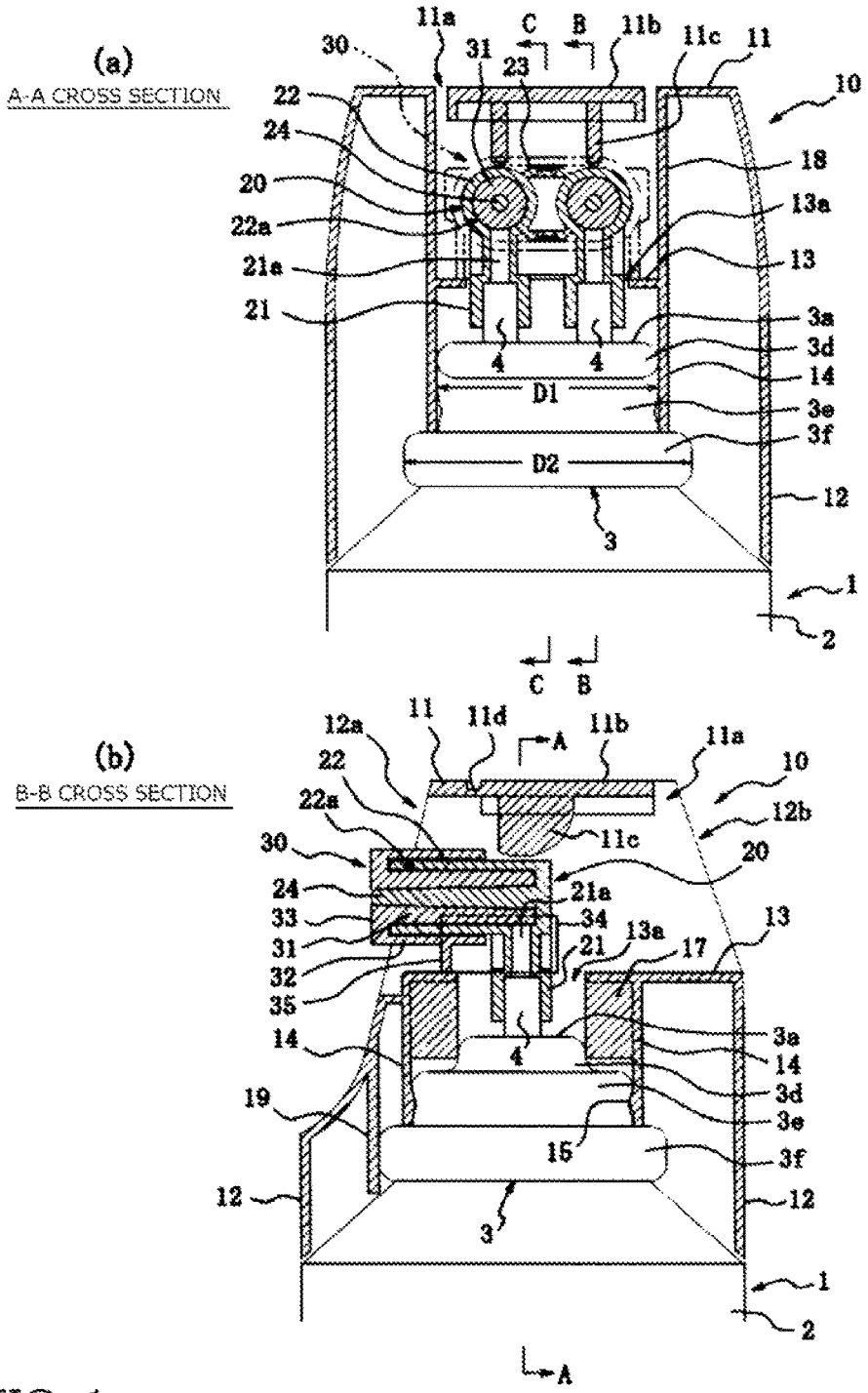
FIG. 1 illustrates one embodiment of a shoulder cover for aerosol container according to the present invention in a state in which it is mounted to the aerosol container, (*a*) being a longitudinal cross-sectional view in front view (cross-sectional view along A-A of (*b*)), and (*b*) being a longitudinal cross-sectional view in side view (cross-sectional view along B-B of (*a*)). (*a*) illustrates the aerosol container in a front view, and (*b*) in a side view. The phantom line in FIG. 1(*a*) indicates the front view of a cleaning member shown in FIG. 3(*a*).
Figure 2:
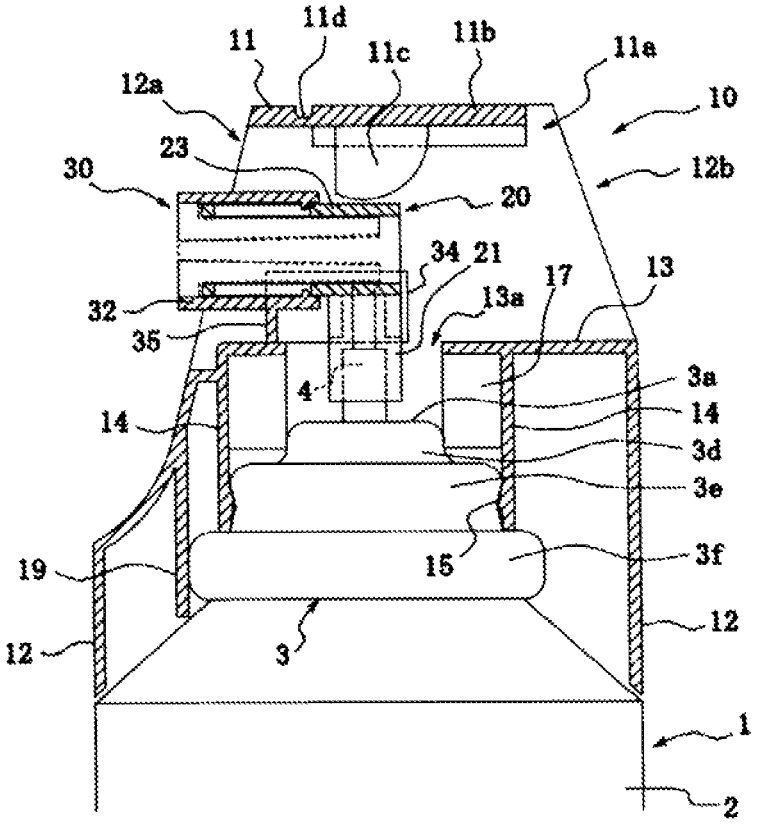
FIG. 2 is a cross-sectional view along C-C of FIG. 1(*a*), and illustrates the aerosol container in a side view.

1: Container (aerosol container)
2: Container body
3: Mounting cup
3*a*: Top wall
3*b*: Long side
3*c*: Short side
3*d*: Upper tier part
3*e*: Middle tier cylindrical part (cylindrical part)
3*f*: Lower tier cylindrical part
3*g*: Long side edge
3*h*: Short side edge
4: Stem
10: Shoulder cover
11: Roof wall
11*a*: Cut-out portion
11*b*: Actuator part
11*c*: Rib
11*d*: Hinge
12: Outer circumferential wall
12*a*, 12*b*: Opening
13: Partition wall
13*a*: Opening
14: Cylindrical wall
15, 48: Convex section
16: Portion without convex section
17: Rib (anti-rotation rib)
18: Connecting wall
19: Reinforcing wall
20: Nozzle body
21: Vertical tube
21*a*: Vertical passage
22: Horizontal tube
22*a*: Horizontal passage
23: Connecting part
24: Pin
30: Cleaning member
31: Tubular wall
32: Circumferential wall
33: Support wall
34: Side wall
35: Front wall
36: Tab
40: Shoulder cover
41: Roof wall
42: Outer circumferential wall
43: Opening
44: Inner circumferential wall
45: Weakened portion
46: Annular wall
46*a*: Lower end of annular wall
47: Cylindrical wall
49: Slit
A1: Convex-shaped region
A2: Non-convex-shaped region
D1: Diameter of middle tier cylindrical part (cylindrical part)
D2: Diameter of lower tier cylindrical part
D3: Inner diameter of cylindrical wall
L1: Distance between convex sections
Ha: Top wall height
Hb: Upper face height of middle tier cylindrical part

MODES FOR CARRYING OUT THE INVENTION

Hereinafter, the present invention will be described in more specific terms with reference to the drawings.

FIG. 1 illustrates one embodiment of a shoulder cover for aerosol container according to the present invention in a state in which it is mounted to the aerosol container. "Front side" herein refers to the side where the outlet port of the nozzle body is positioned, with reference to FIG. 1(*b*), while "backside" refers to the opposite side of a center axial line of the aerosol container.

In FIGS. 1(*a*) and (*b*), reference numeral 1 denotes an aerosol container (hereinafter sometimes referred to simply as "container") to which the shoulder cover of the present invention is to be mounted. The container 1 is formed by a cylindrical container body 2 made of metal, for example, with a mounting cup 3 similarly made of metal fixedly attached thereto by, for example, crimping the outer edge of the cup, and contains two types of contents separately inside. The container 1 includes two stems 4 that each lead to housing spaces of respective contents.

Figure 6:
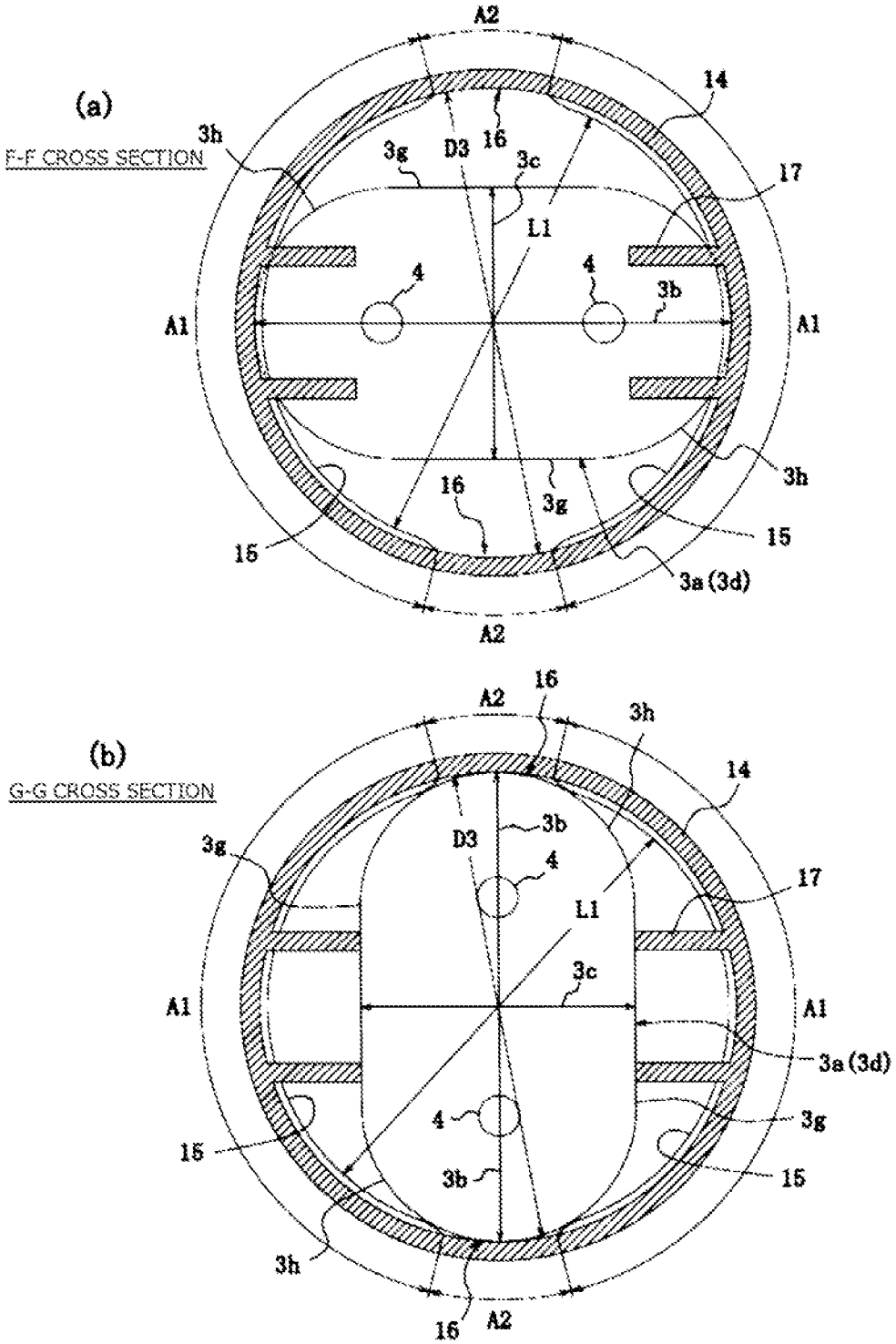
FIG. 6 illustrates the relationship between an upper tier part of the aerosol container and the convex-shaped region and non-convex-shaped region of the shoulder cover, (*a*) being a cross-sectional view along F-F of FIGS. 4(*b*) and (*b*) being a cross-sectional view along G-G of FIG. 5(*b*).

In the center of the mounting cup 3 are provided, as shown in FIGS. 1(*a*) and (*b*), and FIGS. 6(*a*) and (*b*), an upper tier part 3*d*, which has the stems 4 protruding from a top wall 3*a* thereof, and has a non-circular cross-sectional shape with long sides 3*b* and short sides 3*c*, a cylindrical part having a diameter D1 substantially the same as the length of the long sides 3*b* and connecting to the upper tier part 3*d* (hereinafter referred to as "middle tier cylindrical part 3*e*" in this embodiment), and a lower tier cylindrical part 3*f* having a diameter D2 larger than the diameter D1 of the middle tier cylindrical part 3*e* and connecting to the middle tier cylindrical part 3*e*. Here, the "long sides" refer to portions of the cross-sectional shape of the upper tier part 3*d* having a largest length between opposing sides, while the "short sides" refer to portions of the cross-sectional shape of the upper tier part 3*d* having a smallest length between opposing sides. Namely, "non-circular shape with long sides and short sides" means shapes other than circular, and includes rectangular, track shape, and elliptical, for example. In this embodiment, the upper tier part 3*d* is shaped in the form of a track as shown in FIGS. 6(*a*) and (*b*), and includes a pair of long side edges 3*g* extending straight along the long sides 3*b*, and a pair of short side edges 3*h* that connect both ends of the long side edges 3*g* in a circular arc. The stems 4 are aligned in series along the long sides 3*b* in a central part of the upper tier part 3*d*.

Reference numeral 10 in FIGS. 1(*a*) and (*b*) shows one embodiment of the shoulder cover of the present invention. The shoulder cover 10 refers to a component that is attached to the container 1 such as to encase the mounting cup 3 inside, and includes, not only the one that is directly visible itself from the outside to be used as an exterior part as in this embodiment, but also the one commonly referred to as a fixing plate and used with another cover further attached outside.

The shoulder cover 10 of this embodiment includes a roof wall 11 extending horizontally and having a cut-out portion 11*a* in the center, and an outer circumferential wall 12 that is connected to the outer rim of the roof wall 11, has openings 12*a* and 12*b* on the front side and backside, respectively, and is cylindrical to be continuous with the container body 2. In the cut-out portion 11*a* is provided an actuator part 11*b*, which is a portion to be pressed by a finger when dispensing the contents inside the container 1. A pair of ribs 11*c* having an arcuate shape in side view are provided on the backside of the actuator part 11*b*, to abut on the nozzle body to be described later when the actuator part is pressed by a finger. The actuator part 11*b* is integrally connected to the roof wall 11 via a thinly formed hinge 11*d*.

As shown in FIG. 1(*b*), a horizontally extending partition wall 13 is provided below the roof wall 11. An opening 13*a* is provided in the partition wall 13 for exposing the stems 4. On the lower side of the partition wall 13 is provided a downwardly extending cylindrical wall 14. A pair of convex sections 15 protruding radially inward from a lower part of the inner circumferential surface of the cylindrical wall 14 are provided such as to be circumferentially spaced and opposite from each other as shown in FIG. 6(*a*) (in this embodiment, the convex sections 15 are each provided on the sides where the openings 12*a* and 12*b* are provided). In convex-shaped regions A1 formed with the convex sections 15, the distance L1 between the opposite convex sections 15 is shorter than the length of the long sides 3*b*. Portions 16 without the convex sections 15 are provided at opposite positions, too. In non-convex-shaped regions A2 with these portions 16, the inner diameter D3 of the opposing faces of the cylindrical wall 14 is the same as or longer than the length of the long sides 3*b*. In this embodiment, as shown in FIG. 1(*b*), the convex sections 15 are provided at a position higher than the lower end of the cylindrical wall 14.

A total of four ribs (anti-rotation ribs) 17 protruding radially inwards as shown in FIG. 6(*a*) are provided in an upper part of the cylindrical wall 14 as shown in FIG. 1(*b*).

The shoulder cover 10 further includes a pair of connecting walls 18 that connect the edges of the cut-out portion 11*a* of the roof wall 11 with the partition wall 13 as shown in FIG. 1(*a*). Between the connecting walls 18 is formed a space for disposing the nozzle body to be described later. A reinforcing wall 19 that abuts on an outer circumferential surface of the lower tier cylindrical part 3*f* is provided between the outer circumferential wall 12 and the cylindrical wall 14 as shown in FIG. 1(*b*).

In FIGS. 1(*a*) and (*b*), reference numeral 20 denotes the nozzle body that connects to the two stems 4 to dispense the contents. The nozzle body 20 includes vertical tubes 21 having vertical passages 21 therein, which the contents from the stems 4 flow into, and horizontal tubes 22 integrally connected to the vertical tubes 21 and having horizontal passages 22*a* that lead to the vertical passages 21*a*. Two sets of the vertical tube 21 and horizontal tube 22 are provided side by side, with a connecting part 23 between them. A pin 24 that is tapered from the vertical passage 21*a* side to the outlet side is provided in the center of each horizontal passage 22*a*.

Figure 3:
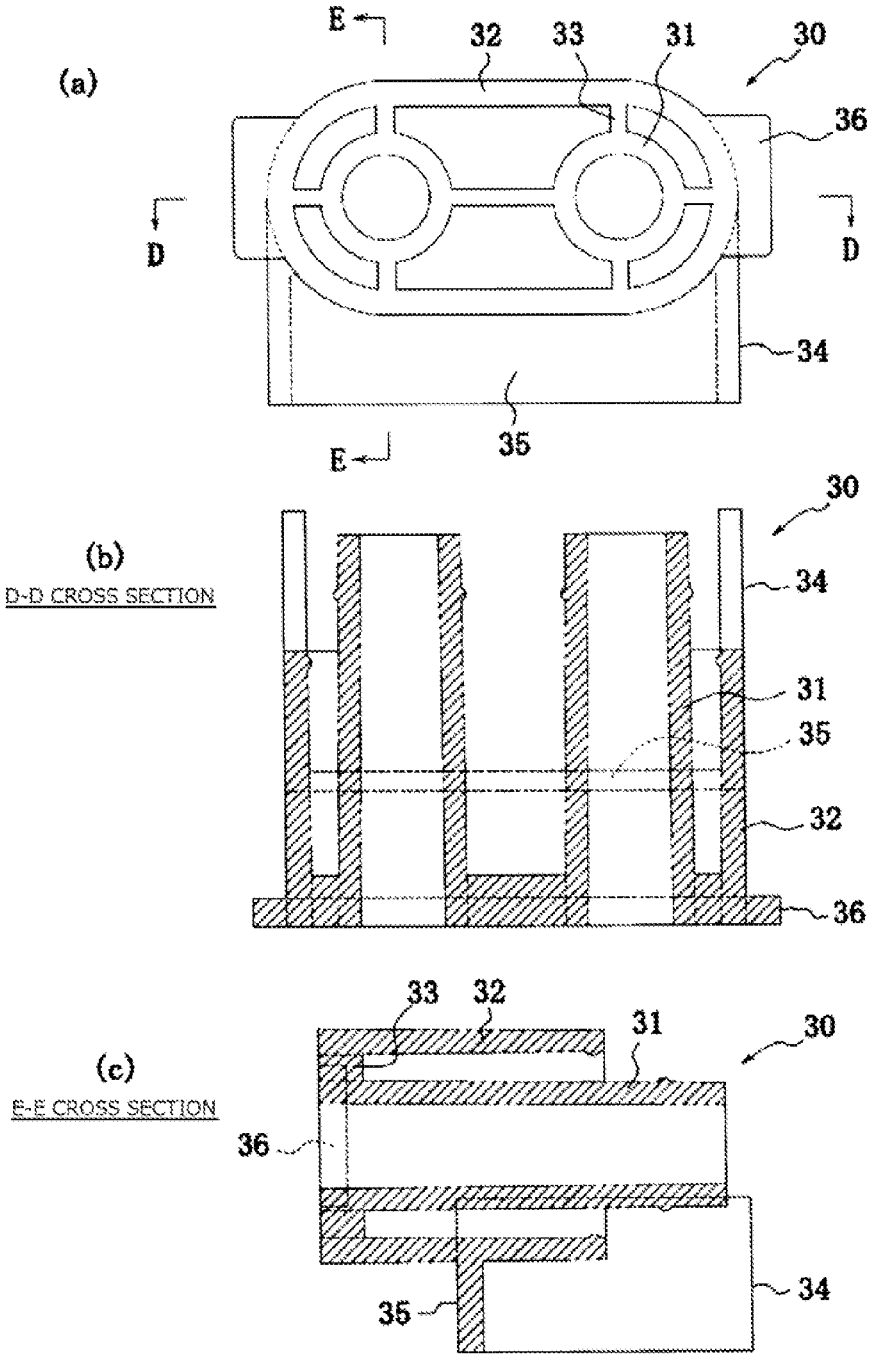
FIG. 3 illustrates the cleaning member shown in FIG. 1, (*a*) being a front view, (*b*) being a cross-sectional view along D-D of (*a*), and (*c*) being a cross-sectional view along E-E of (*a*).

On the outlet side of the nozzle body 20, as shown in FIG. 1(*b*), a cleaning member 30 is provided, which is used such that it is pulled out from the vertical passage 21*a* side to the outlet side to allow the contents to be discharged, and pushed in reversely when residual contents remaining inside the nozzle body 20 are to be removed. The cleaning member 30 has two tubular walls 31 that are to enter the horizontal passages 22*a*, which are integrally connected via support walls 33 to a circumferential wall 32 that collectively surrounds the horizontal tubes 22 and has a track shape in a cross section, as shown in FIGS. 3(*a*) to (*c*). Below the circumferential wall 32 are a pair of side walls 34 and a front wall 35 that connects these side walls 34, which will abut on the upper face of the partition wall 13 when assembled to the nozzle body 20. On the sides of the circumferential wall 32 are a pair of tabs 36 that will let a finger to take hold of the cleaning member 30 to pull it out or push it in.

Figure 4:
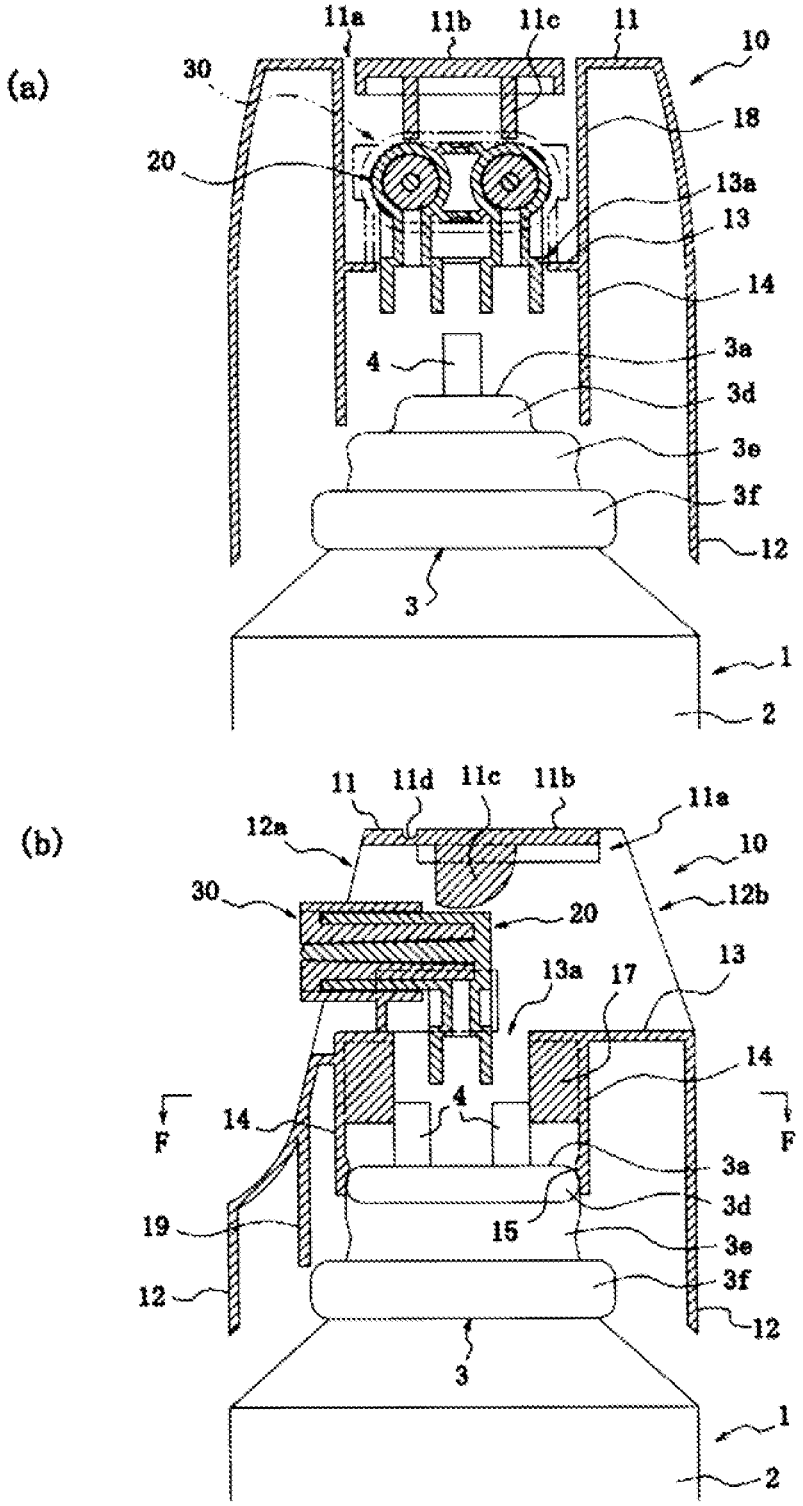
FIG. 4 is a diagram for explaining how the shoulder cover shown in FIG. 1 is attached to the aerosol container, and illustrates a state in which the shoulder cover is placed on a mounting cup so that convex sections of the shoulder cover ride on the top wall of an upper tier part of the mounting cup, (*a*) being a diagram corresponding to FIGS. 1(*a*), and (*b*) being a diagram corresponding to FIG. 1(*b*).

To attach the shoulder cover 10 configured as described above to the container 1, the nozzle body 20 with the cleaning member 30 assembled thereto is temporarily attached to the shoulder cover 10, for example, and this shoulder cover 10 is placed on top of the mounting cup 3 of the container 1, as shown in FIGS. 4(*a*) and (*b*). If the container 1 and the shoulder cover 10 are not aligned with each other as shown in FIG. 6(*a*) (the convex-shaped regions A1 overlapping the long sides 3*b* of the upper tier part 3*d*), the convex sections 15 ride on the top wall 3*a* of the upper tier part 3*d* as shown in FIG. 4(*b*) since the distance L1 between the opposite convex sections 15 is shorter than the length of the long sides 3*b*.

Figure 5:
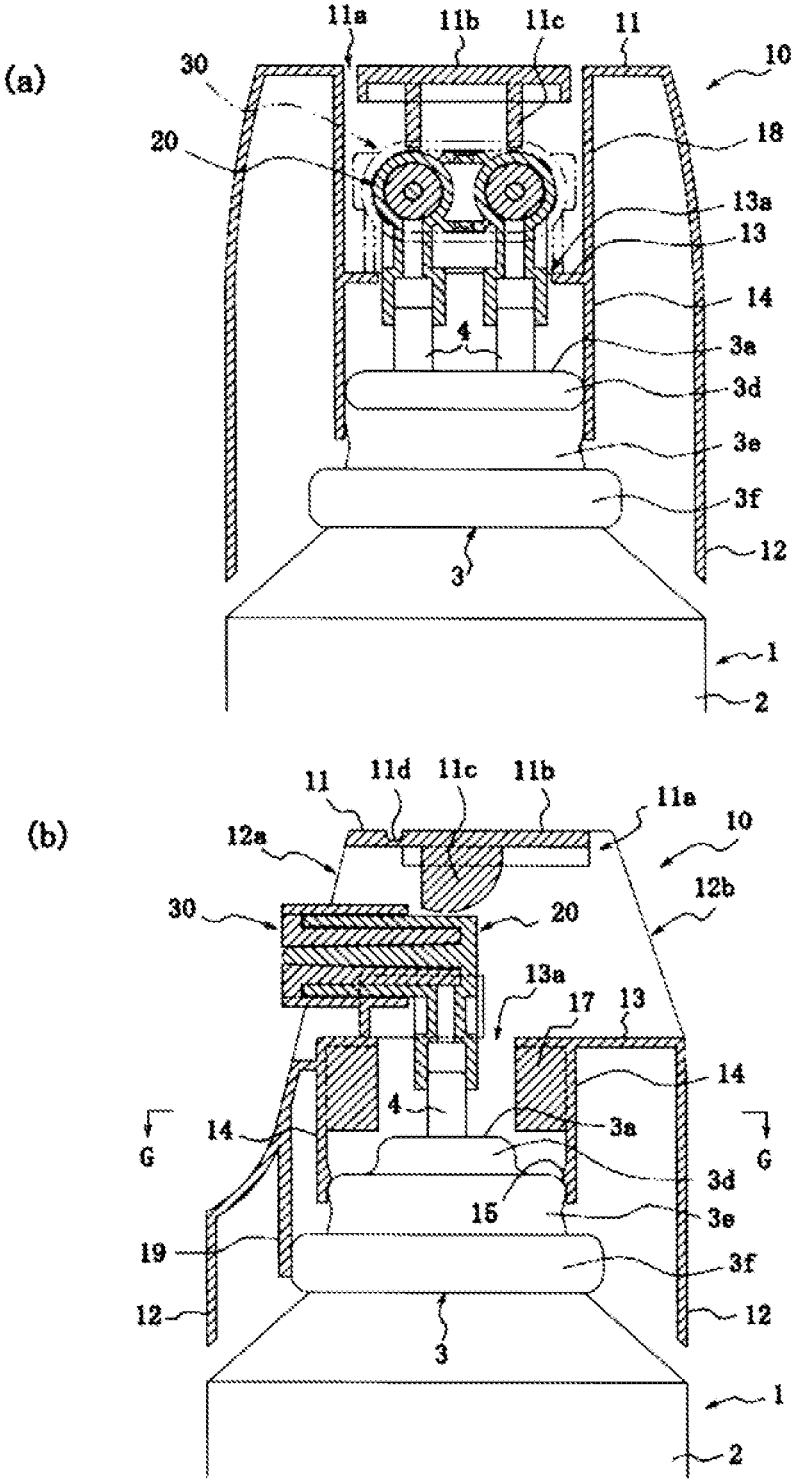
FIG. 5 illustrates a state in which the aerosol container is rotated 90 degrees relative to the shoulder cover from the state of FIG. 4, and the shoulder cover is moved down until the convex sections of the shoulder cover abut on a cylindrical part of the mounting cup, (*a*) being a diagram corresponding to FIGS. 4(*a*), and (*b*) being a diagram corresponding to FIG. 4(*b*).

When the container 1 is turned relative to the shoulder cover 10 (or the container 1 may be held while the shoulder cover 10 is turned) and the container 1 and shoulder cover 10 are aligned with each other as shown in FIG. 6(*b*) (where the long sides 3*b* of the upper tier part 3*d* coincide with the circumferential positions of the non-convex-shaped regions A2), the shoulder cover 10 moves down until the convex sections 15 abut on the middle tier cylindrical part 3*e* as shown in FIG. 5(*b*). Namely, that the positioning is complete is made known by the height of the shoulder cover 10 going down. In this embodiment, since the convex sections 15 are provided higher than the lower end of the cylindrical wall 14, the cylindrical wall 14 positioned lower than the convex sections 15 functions as a guide when the container 1 is rotated relative to the shoulder cover 10, so that the container can be rotated without displacement.

After that, the shoulder cover 10 is pressed from above, whereupon the convex sections 15 engage with the outer circumferential surface of the middle tier cylindrical part 3*e* as shown in FIGS. 1(*a*) and (*b*), so that the shoulder cover 10 is retained to the container 1. Since the ribs 17 provided to the cylindrical wall 14 are disposed such as to contact the long side edges 3*g* of the upper tier part 3*d* as shown in FIG. 1(*b*) and FIG. 6(*b*), the shoulder cover 10 is more firmly retained to the container 1 and stopped from rotating further. Thus, in this embodiment, the convex sections 15 constitute locking means, as well as positioning means, since the convex sections are formed by providing convex-shaped regions and non-convex-shaped regions.

In the attachment method described above, the nozzle body 20 and cleaning member 30 are attached to the shoulder cover 10 in advance. Instead, the shoulder cover 10 only may be attached to the container 1, by positioning it as described above, after which the nozzle body 20 and cleaning member 30 can be inserted and attached to the stems 4 through a gap between the actuator part and the partition wall 13, which can be widened by tilting the actuator part 11*b* upwards.

When the actuator part 11*b* is pressed down from the state shown in FIGS. 1(*a*) and (*b*), the ribs 11*c* abut on the upper face of the nozzle body 20, so that the two stems 4 can both be pushed down and thus the two types of contents in the container 1 can be dispensed simultaneously. After the contents have been dispensed, the contents remaining inside the nozzle body 20 may clot. Therefore, the nozzle body 20 and cleaning member 30 are removed, and the pulled-out cleaning member 30 is then pushed into the nozzle body 20, whereupon the residual contents inside the horizontal passages 22*a* are pushed in by the tubular walls 31 of the cleaning member 30 and emptied (cleaned) through the vertical passages 21*a*.

Figure 7:
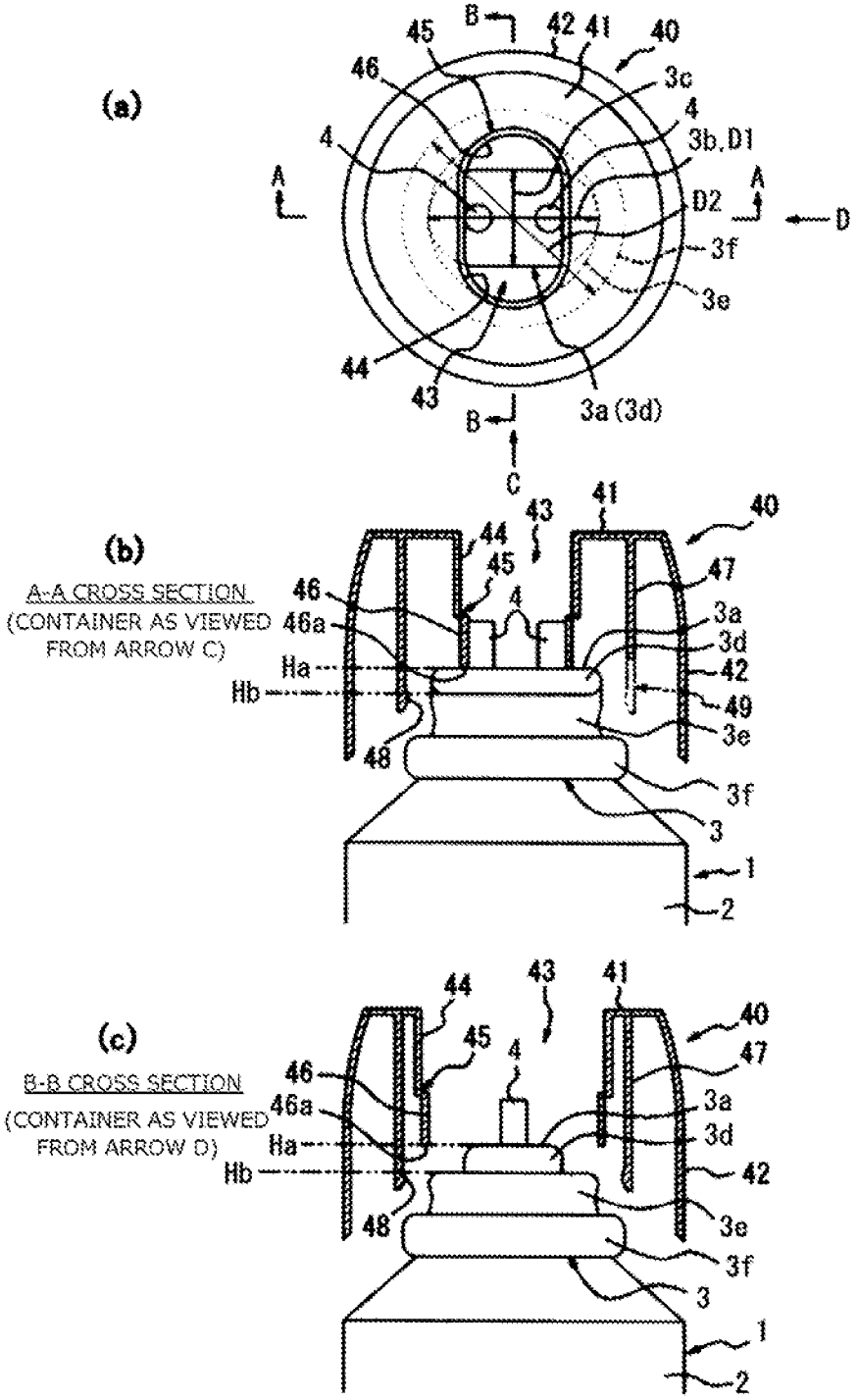
FIG. 7 illustrates another embodiment of a shoulder cover for aerosol container according to the present invention, together with the aerosol container, (*a*) being a plan view, (*b*) being a cross-sectional view along A-A of (*a*) (the aerosol container being viewed from the direction of arrow C in (*a*)), and (*c*) being a cross-sectional view along B-B of (*a*) (the aerosol container being viewed from the direction of arrow D in (*a*)).
Figure 8:
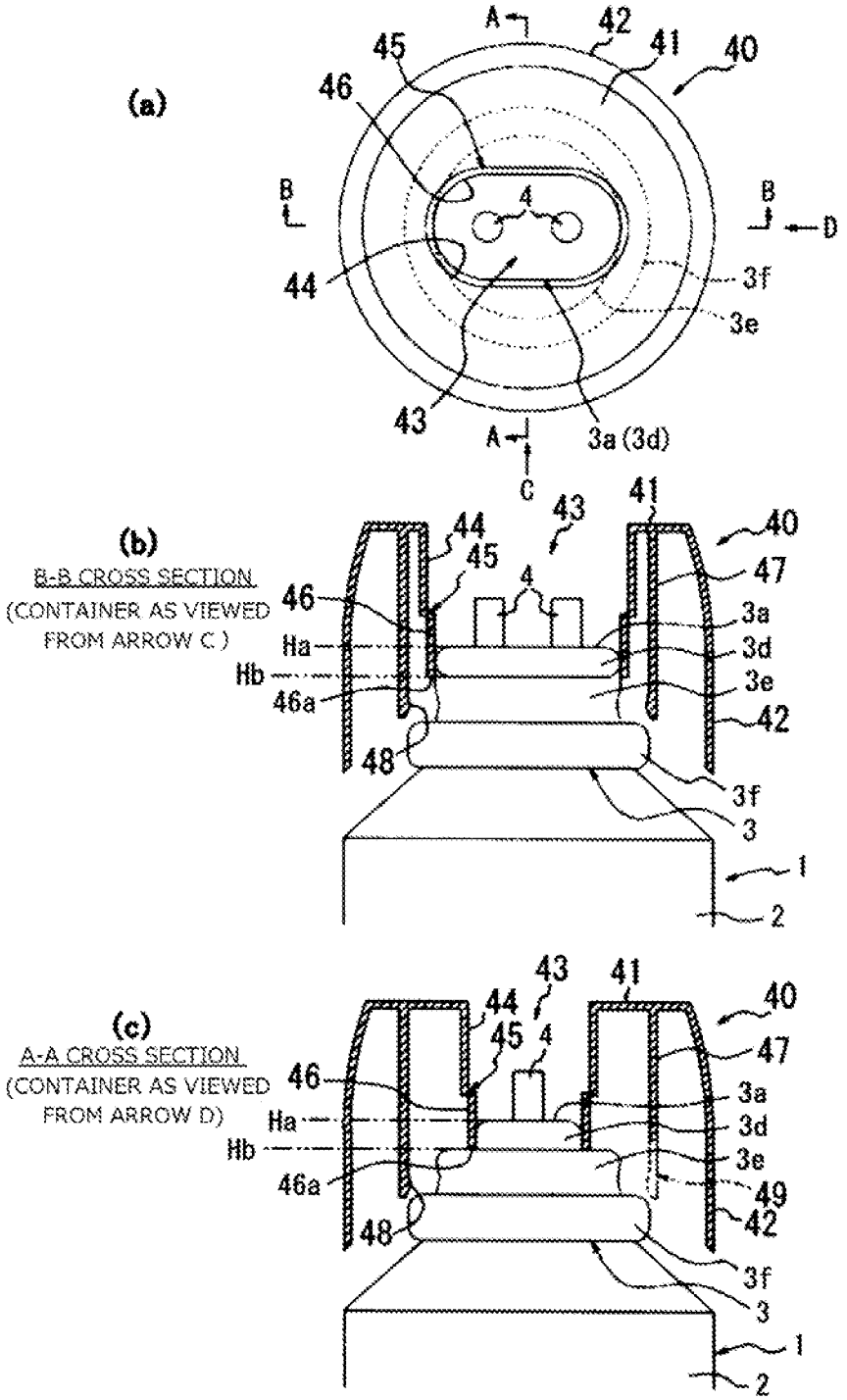
FIG. 8 illustrates a state in which the shoulder cover is rotated 90 degrees relative to the aerosol container from the state of FIG. 7, and the shoulder cover is moved down until an annular wall of the shoulder cover reaches a middle tier cylindrical part of the aerosol container, (*a*) being a plan view, (*b*) being a cross-sectional view along B-B of (*a*) (the aerosol container being viewed from the direction of arrow C in (*a*)), and (*c*) being a cross-sectional view along A-A of (*a*) (the aerosol container being viewed from the direction of arrow D in (*a*)).
Figure 9:
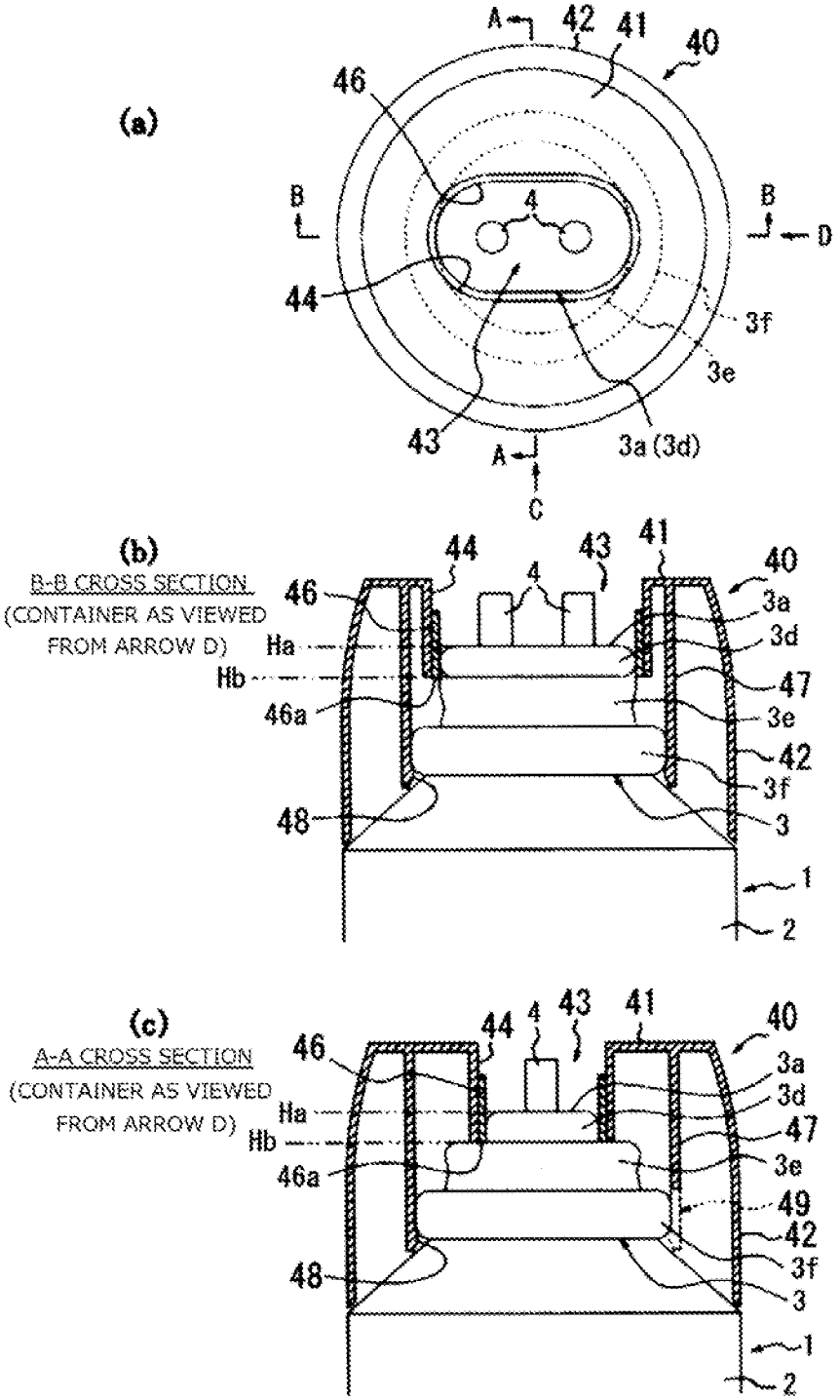
FIG. 9 illustrates a state in which a weakened portion breaks and claws of the shoulder cover engage with a lower tier cylindrical part of the aerosol container when the shoulder cover is pressed down from the state of FIG. 8, (*a*) being a plan view, (*b*) being a cross-sectional view along B-B of (*a*) (the aerosol container being viewed from the direction of arrow C in (*a*)), and (*c*) being a cross-sectional view along A-A of (*a*) (the aerosol container being viewed from the direction of arrow D in (*a*)).

FIG. 7 to FIG. 9 illustrate another embodiment of the present invention together with the aerosol container. The aerosol container 1 is the same as that of the embodiment described above. As shown in FIGS. 7(*b*) and (*c*), the top wall 3*a* has a height Ha from the bottom (not shown) of the container body 2 as the reference surface, and the upper face of the middle tier cylindrical part 3*e* has a height Hb from this reference bottom surface.

In FIGS. 7(*a*) to (*c*), reference numeral 40 denotes the shoulder cover according to this embodiment. The shoulder cover 40 of this embodiment includes a disc-shaped roof wall 41, and an outer circumferential wall 42 that is cylindrical to be continuous with the container body 2, extending downward from the outer rim of the roof wall 41 and slightly curved radially outward. In the center of the roof wall 41 is provided an opening 43 that is in the form of a track in this embodiment, and at the edge of the opening 43 is provided a downwardly extending inner circumferential wall 44. Further, at the lower end of the inner circumferential wall 44 is provided an annular wall 46 integrally connected thereto via a weakened portion 45 and having an inner circumferential shape conforming to an outer circumferential surface of the upper tier part 3*d* (track shape in this embodiment). In FIGS. 8(*b*) and (*c*), the portion denoted by reference numeral 46*a* is the lower end of the annular wall 46.

The weakened portion 45 is a portion with lower strength relative to the inner circumferential wall 44 and the annular wall 46. Such a weakened portion 45 may be formed as a thin wall, for example, that is thinner than the inner circumferential wall 44 and the annular wall 46, or formed as a plurality of connecting pieces circumferentially spaced along the annular wall 46 and intermittently connecting the inner circumferential wall 44 and the annular wall 46. Alternatively, the inner circumferential wall 44 and the annular wall 46 may be integrally formed by two-color molding, for example, with the use of a material having lower strength than these walls. Any configuration that is deemed to be suitable in consideration of the ease of forming and strength, etc. may be used as required.

The shoulder cover 40 further includes a cylindrical wall 47 in between the outer circumferential wall 42 and the inner circumferential wall 44, extending downwardly from the roof wall 41 and having an inner circumferential diameter substantially the same as that of the lower tier cylindrical part 3*f* of the mounting cup 3. At the lower end of the cylindrical wall 47 are provided claws 48 that protrude radially inward, and a slit 49 formed by cutting part of the cylindrical wall 47 (see FIG. 7(*b*)).

To attach the shoulder cover 40 configured as described above to the container 1, the shoulder cover 40 is placed on top of the mounting cup 3 of the container 1. If the container 1 and the shoulder cover 40 are not aligned with each other, the lower end 46*a* of the annular wall 46 abuts on the top wall 3*a* (having height Ha) of the upper tier part 3*d*, as shown in FIG. 7(*b*). In this state, the convex sections 48 are located above the lower tier cylindrical part 3*f*.

After that, the shoulder cover 40 is turned relative to the container 1. As described above, since the convex sections 48 are located above the lower tier cylindrical part 3*f*, the shoulder cover 40 turns without resistance. When the upper tier part 3*d* and the annular wall 46 are aligned with each other, the annular wall 46 fits with the upper tier part 3*d*, and its lower end 46*a* moves to the upper face of the middle tier cylindrical part 3*e* (having height Hb) as shown in FIGS. 8(*a*) to (*c*). Namely, that the positioning of the shoulder cover 40 is complete is made known by the height of the shoulder cover 40 going down by (Ha−Hb). Thus, in this embodiment, the convex sections 48 constitute locking means, while the inner circumferential wall 44 and the annular wall 46 constitute positioning means.

After that, the shoulder cover 40 is pressed from above, whereupon the annular wall 46 breaks off at the weakened portion 45, and the convex sections 48 of the cylindrical wall 47 engage with the lower tier cylindrical part 3*f* as shown in FIGS. 9(*a*) to (*c*), so that the shoulder cover 40 is retained to the container 1. Since the annular wall 46 is continuous all around, it has high rigidity, and does not flex or bend when the shoulder cover 40 is pressed from above, and can therefore reliably break off at the weakened portion 45. Since the cylindrical wall 47 has the slit 49, the cylindrical wall 47 can be flexed radially outward when it makes engagement, so that no significant force is required for the engagement. In this way, while the annular wall 46 plays a role to position the shoulder cover 40, it breaks off at the weakened portion 45 and gets into the shoulder cover 40 for the shoulder cover 40 to be retained to the container 1, so that the shoulder cover height can be kept to the same height as when no annular wall 46 is provided.

After that, although not shown, a nozzle that has one discharge tube connecting and leading to each of the two stems 4 is prepared, and this nozzle is connected to the stems 4 through the opening 43 in the shoulder cover 40. Then, by pressing the nozzle from above, the two types of contents inside the container 1 can be dispensed simultaneously.

INDUSTRIAL APPLICABILITY

According to the present invention, a novel shoulder cover for aerosol container that can readily be positioned to an aerosol container with two stems and thereby facilitates assembling work can be provided.

The invention claimed is:

1. A shoulder cover for an aerosol container and attachable to the aerosol container having a mounting cup, such as to encase the mounting cup inside, the mounting cup including an upper tier part having two stems protruding from a top wall thereof and having a non-circular cross-sectional shape with long sides and short sides, and a cylindrical part including a middle tier cylindrical part having a diameter substantially the same as the length of the long sides and connected to the upper tier part, and a lower tier cylindrical part having a larger diameter than that of the middle tier cylindrical part and connected to the middle tier cylindrical part, the shoulder cover for the aerosol container comprising:

an outer circumferential wall, a roof wall, a cylindrical wall extending downward from the roof wall separately from the outer circumferential wall, and locking means formed by a convex section that is formed on an inner circumferential surface of the cylindrical wall and that retains the shoulder cover by engaging with the cylindrical part of the mounting cup, wherein positioning means for fitting with the non-circular upper tier part of the mounting cup to thereby position a mating position in a circumferential direction of the shoulder cover is formed.

2. The shoulder cover for aerosol container according to claim 1, wherein the locking means is formed of a pair of convex sections circumferentially spaced in a lower part of the inner circumferential surface of the cylindrical wall that fits with the middle tier cylindrical part, and the positioning means includes a convex-shaped region where the convex sections are provided to face each other on the cylindrical wall and where a distance between the convex sections is shorter than the length of the long sides, and a non-convex-shaped region where portions not formed with the convex sections are provided to face each other and where the cylindrical wall has an inner diameter that is equal to or longer than the length of the long sides.

3. The shoulder cover for aerosol container according to claim 2, wherein the cylindrical wall has an anti-rotation rib that abuts on a long side edge of the upper tier part along the long sides, at a position higher than the convex sections.

4. The shoulder cover for aerosol container according to claim 1, wherein the locking means is formed of a convex section provided in a lower part of the inner circumferential surface of the cylindrical wall that fits with the lower tier cylindrical part, and the positioning means includes an inner circumferential wall extending downward from and integrally connected to the roof wall, and an annular wall integrally connected to a lower end of the inner circumferential wall via a weakened portion and having an inner circumferential shape conforming to an outer circumferential surface of the upper tier part, the annular wall having a lower end that abuts on the top wall at a position where the convex section is located above the lower tier cylindrical part when the shoulder cover is placed on top of the mounting cup.

5. The shoulder cover for aerosol container according to claim 4, wherein the weakened portion is a thin wall that is thinner than the inner circumferential wall and the annular wall.

6. The shoulder cover for aerosol container according to claim 5, wherein the weakened portion is a plurality of connecting pieces spaced along the circumferential direction of the annular wall and intermittently connecting the inner wall and the annular wall.

7. The shoulder cover for aerosol container according to claim 4, wherein the weakened portion is a plurality of connecting pieces spaced along the circumferential direction of the annular wall and intermittently connecting the inner wall and the annular wall.

* * * * *